US005482485A

United States Patent [19]

Ball

[11] Patent Number: 5,482,485

[45] Date of Patent: Jan. 9, 1996

[54] AQUATIC MANEUVERING DEVICE

[76] Inventor: Roger L. Ball, 345 Ball Dr., Tallahassee, Fla. 32312

[21] Appl. No.: 293,589

[22] Filed: Aug. 22, 1994

[51] Int. Cl.[6] ..... B63B 35/79

[52] U.S. Cl. ..... 441/65; 441/79; 114/253

[58] Field of Search ..... 114/253, 254, 114/315; 441/65, 66, 67, 74, 68, 69, 79

[56] References Cited

U.S. PATENT DOCUMENTS

| | | | |
|---|---|---|---|
| 3,570,436 | 3/1971 | Vasseur | 114/16 |
| 3,604,031 | 9/1971 | Cahill | 441/65 |
| 3,617,070 | 11/1971 | Roberts | 441/65 |
| 3,650,234 | 3/1972 | Goudy | 114/315 |
| 3,931,777 | 1/1976 | Colgan | 114/16 |
| 4,149,483 | 4/1979 | Scott, Jr. | 114/332 |
| 4,700,654 | 10/1987 | Borges | 114/338 |
| 5,007,871 | 4/1991 | Dyor | 441/65 |
| 5,134,955 | 8/1992 | Manfield | 114/332 |
| 5,318,467 | 6/1994 | McIntyre | 441/65 |

*Primary Examiner*—Stephen Avila
*Attorney, Agent, or Firm*—Peter Loffler

[57] ABSTRACT

An underwater maneuvering device is disclosed. The device consists of a base member and a pair of perpendicularly disposed fins. A hand grip on the base member provides vertical and horizontal directional control. Hand grips on the fins provide also vertical and horizontal directional control. The device can be disassembled for easy storage and transport.

4 Claims, 3 Drawing Sheets

AQUATIC MANEUVERING DEVICE

BACKGROUND OF THE INVENTION

1. Field of the Invention

The present invention generally relates to an aquatic maneuvering device and more specifically to an improved maneuvering device for use on and under the water whenever the user is being propelled through the water by auxiliary means such as a tow boat or jet ski, or by the propulsion effects of water current.

2. Background of the Prior Art

Water-borne activities are extremely popular. Such activities take place in rivers, lakes, oceans, and just about anywhere a suitable body of water can be found. These activities include those performed both under and above the water surface.

People spend a lot of time engaged in underwater activities. Included activities are scallop and clam searching, spear fishing, sand dollar harvesting, sightseeing, photography, etc.

Typically, a person engaged in underwater activities will wear scuba diving equipment. The scuba diving equipment permits a person to stay underwater for an extended period of time.

A person engaged in underwater activities will want to be able to maneuver easily. For instance, when a person sees a clam bed off to one side, that person will want to get there quickly. An underwater maneuvering device will prove of great benefit to such a person.

In providing for underwater maneuverability, two distinct methods exist. The first method involves the use of underwater propulsion vehicles. These vehicles are motorized propeller driven craft and are generally battery-powered.

A second approach is to use passive underwater maneuvering devices. Such devices are towed by a vehicle, such as a boat or jet ski, and are adapted to provide a user directional control while underwater.

Passive aquatic maneuvering devices are known in the art. The most significant of these prior inventions is found in U.S. Pat. No. 4,149,483 issued to Scott, Jr. The device is a relatively large flat body member with a submerging and surfacing vane, as well as rolling vanes. Bevel gear-controlled hand grips prove the necessary movement to the particular vanes. The device permits a user to surface and submerge with relative ease. Furthermore, a user can roll or partially roll the device and himself.

U.S. Pat. No. 5,134,955 issued to Manfield discloses a two-person underwater sled similar to the Scott invention.

While the Scott invention provides substantial vertical directional control for a user, it suffers from many setbacks.

The Scott invention, having many moving parts, is relatively complex and expensive to manufacture. Its twin hand controls require substantial coordination and skill for proper use. Furthermore, the twin non-centered controls require the user to use both hands for proper control. The user lacks a free hand for such activities as scallop harvesting or photography. The Scott invention lacks the ability to provide for substantial horizontal directional control. A person desiring to make a quick left or right turn will realize no great benefit from the Scott device.

SUMMARY OF THE INVENTION

The present invention provides for a passive underwater maneuvering device that overcomes the difficulties and shortcomings of current underwater maneuvering devices. The present invention provides substantial underwater maneuverability. It provides for both horizontal and vertical directional control. The device can be operated by one hand, leaving the second hand free for other activities.

The invention is easy to operate and maintain. The device is relatively simple to manufacture and assemble, and is durable and long-lasting.

The underwater maneuvering device of the present invention consists of a horizontally disposed base member. This base member provides vertical directional control. Hand grips on the rear of the base member allow the user to grasp and control the device. This hand grip is used to maintain vertical and horizontal control of the device.

A guide rope or other similar device attaches to the front of the base member. The other end of this guide rope attaches to a boat or similar vehicle in order to tow the invention and user through the water.

Attached to the base member are two vertically disposed stabilizers or fins. These fins are each in the shape of a shark's fin. Each fin extends above and below the base member in symmetrical fashion. Each of the fins is symmetrically disposed off the center line—the center line that runs from the base member's front to its back—of the base member. The plane of the stabilizers is perpendicular to the plane of the base member.

Each of the fins has a hand grip. The use of these two hand grips provides horizontal, vertical, and bi-directional control.

The fins can be detached from the base member. This permits the invention to be disassembled into a small convenient package for easy transport and storage.

The device of the present invention is attached to a boat or other similar propulsion device. Alternatively, the device can be propelled using the water current's propulsion effects.

The user grasps the device by either the fins' hand grips or the base member hand grip. If the fins' hand grips are utilized, horizontal directional control is achieved by reducing tension in one arm. If left-hand travel is desired, tension is reduced in the right arm. If right-hand travel is desired, tension is reduced in the left arm.

If a dive is desired, the user grasps the hand grips at their lower ends. If surfacing is desired, the user grasps the hand grips at their upper ends.

Neither horizontal directional control nor vertical directional control require substantial arm or body strength when the fins' hand grips are utilized.

If the base member hand grip is utilized, horizontal direction control is again achieved by arm tension reduction. If left-hand travel is desired, tension is reduced in the right arm. If right-hand travel is desired, tension is reduced in the left arm.

Alternatively, if left-hand travel is desired, the user shifts his grip to the left-hand side of the hand grip. If right-hand travel is desired, the user shifts his grip to the right-hand side of the hand grip.

If the user desires to dive, he pulls up on the hand grip. If he desires to surface, he pushes down on the hand grip.

Neither horizontal directional control nor vertical directional control require substantial arm or body strength when the base member hand grip is utilized.

Therefore, it is an object of the present to provide for an underwater maneuvering device that can provide horizontal and vertical directional control.

It is another object of the present invention to provide for an underwater maneuvering device that can be operated with one hand.

It is another object of the present invention to provide for an underwater maneuvering device that can be easily disassembled for easy storage and transport.

It is another object of the present invention to provide for an underwater maneuvering device that does not require substantial arm or body strength to operate.

It is a final object of the present invention to provide for an underwater maneuvering device that is of simple construction and is easy to maintain.

BRIEF DESCRIPTION OF THE DRAWINGS

Similar reference numerals refer to similar parts throughout the several views of the invention.

DETAILED DESCRIPTION OF THE PREFERRED EMBODIMENT

Figure 1:
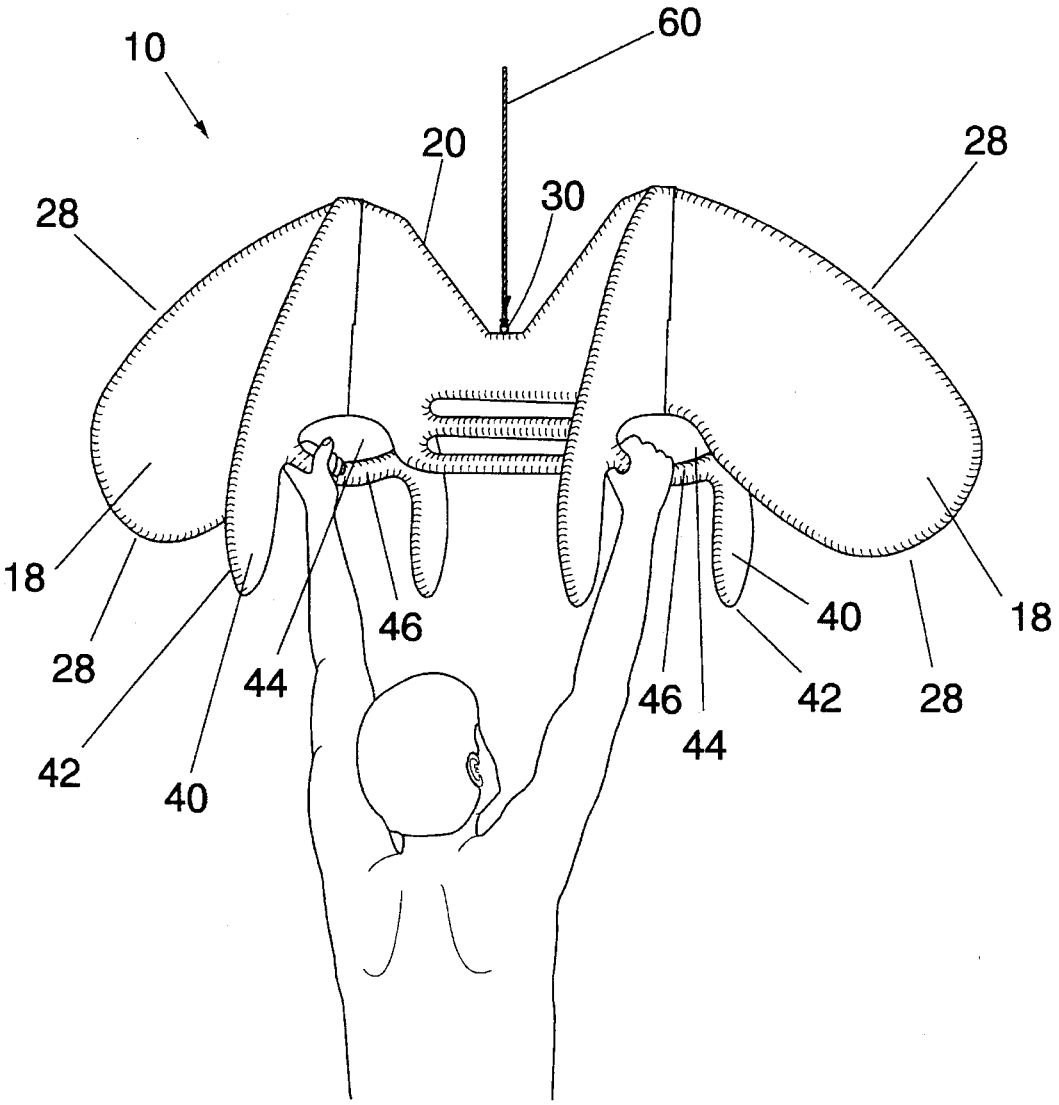
FIG. 1 is an isometric view of the device of the present invention being held by a user on the vertical grips.

The aquatic maneuvering device of the present invention consists of a base member 10. The base member 10 is a panel member. The base member 10 has a top surface 12 and a bottom surface 14. The base member has three portions, a center portion 16, and two wing portions 18. All three portions form an integral unit.

As seen from the top, the base member 10 is shaped much like the letter "W".

The center portion 16 has a front end 20 and a back end 22.

The front end 20 has a cutaway portion. Located in the center of the cutaway portion is an attachment ring 30. This attachment ring 30 receives a tow line 60. The other end of the tow line 60 attaches to a boat, jet ski, or other similar tow vehicle (not illustrated).

The attachment ring 30 is designed to be located in front of the center of gravity of the invention. By being so located, the invention will tilt upward toward the surface when a user releases his hold on the invention. This will cause the device itself to surface. Otherwise, the invention may go downward and get damaged or tangled on the water body's bottom surface.

Located on the back end 22 of the center portion 16 of the base member 10, are a pair of apertures 26. These apertures 26 define a hand grip. The edges of the apertures 26 are rounded to afford a more comfortable grip by the user. Optionally, the hand grip may be padded for additional user comfort.

The wings 18 of the base member 10 are swept backward. The outer tips of the wings 18 are gently curved to reduce water flow turbulence.

The entire base member 10 is tapered. The tapering runs from the front end to the back end of the base member 10. The slope of the tapering on the top side as is identical to the slope of the tapering on the bottom side.

All outer edges 28 of the base member 10 are rounded or beveled. This beveling decrease base member drag as the invention cuts through the water. This increases the aerodynamic properties of the invention and provides a smoother cleaner ride. The beveling on the back edges of the base member 10 decreases water turbulence as is flows off of the base member 10 further increasing the smoothness of the ride for the user.

Alternatively, the outer edges can be pointed (not illustrated) for added aerodynamic flow. However, sharp pointing of the outer edges, while decreasing base member drag, increases the possibility of injury to a person who may be struck or otherwise come in contact with the invention.

A pair of fins 40 attach at the point where the center portion 16 meets the wings. One fin 40 is located to the left of the center of the base member 10, while the other fin 40 is located to the right of the center of the base member 10. The two fins 40 are located an equal distance from the center of the base member 10.

Figure 2:
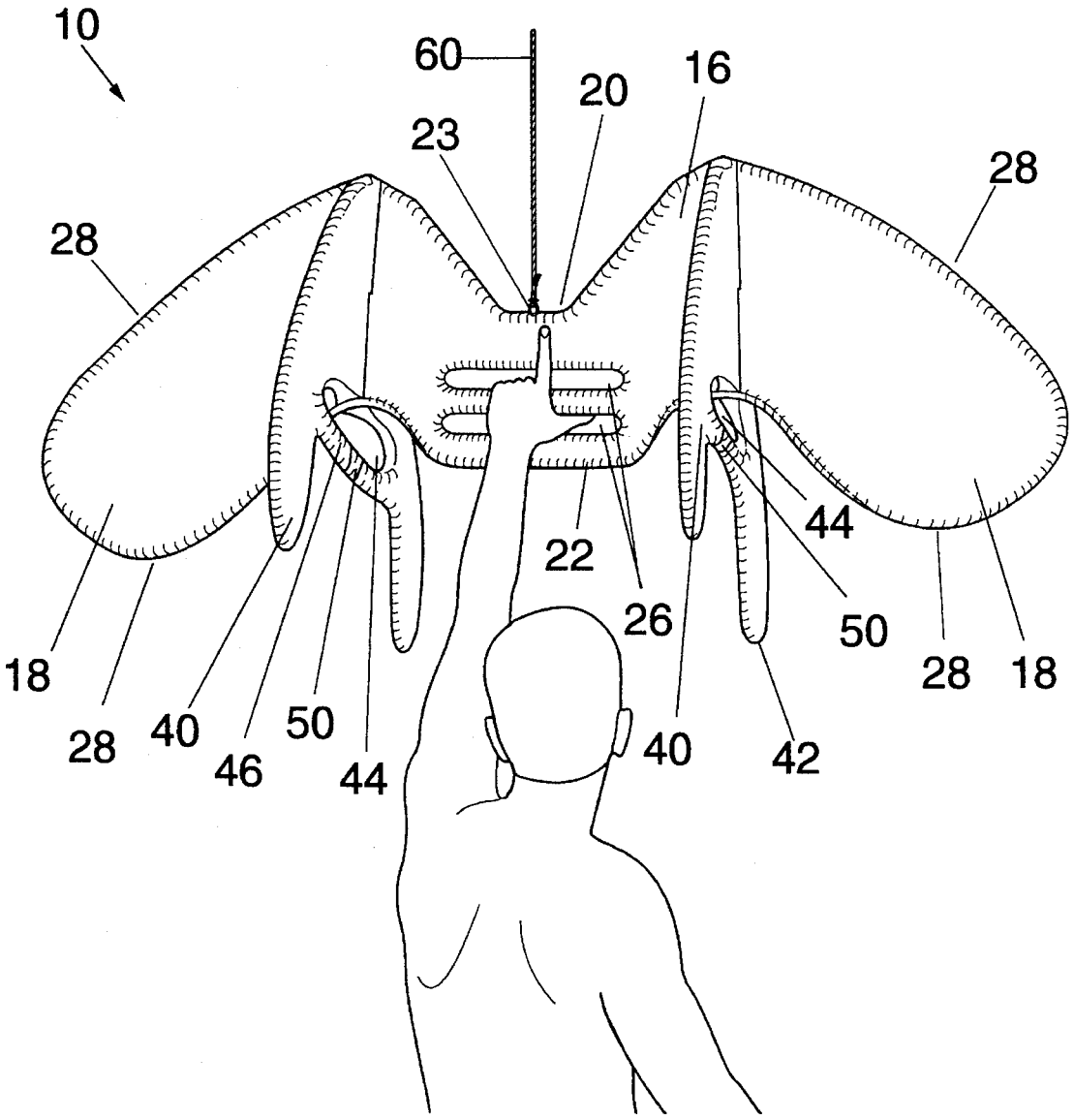
FIG. 2 is an isometric view of the device of the present invention being held by a user on the horizontal grip.
Figure 3:
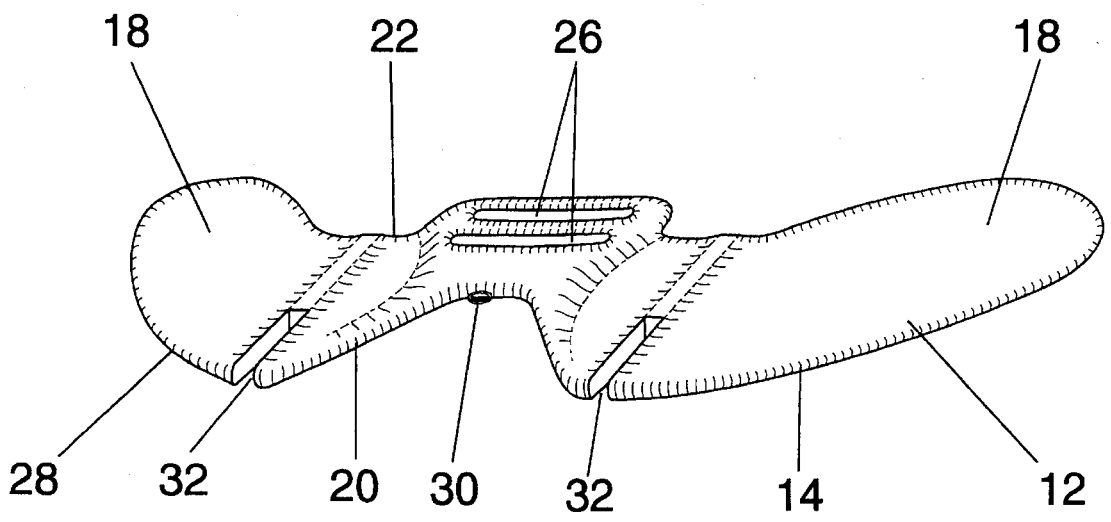
FIG. 3 is a perspective view of the base member of the device of the present invention.
Figure 4:
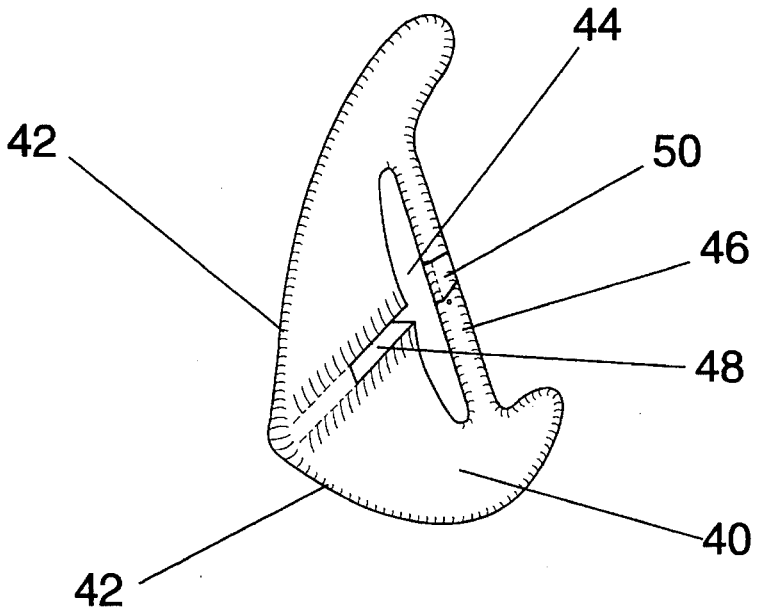
FIG. 4 is a perspective view of the fin of the device of the present invention.

Each fin 40 extends above and below the base member 10. As seen in FIGS. 1, 2, and 4, the upper half of each fin 40 is a shark fin-shaped planer member that curves backward. The lower half of each fin 40 is identical in shape, size, and design to the upper half of each fin 40.

Accordingly, the upper half of the invention is identical and symmetrical to the lower half of the invention. Additionally, the left half of the invention is identical and symmetrical to the right half of the invention. This dual symmetry assures that the device is properly disposed irrespective of which side of the base member is upward facing and which side is downward facing.

All outer edges 42 of each fin 40 are rounded or beveled. This increases the aerodynamic properties of the invention and provides a smoother cleaner ride. The beveling on the back edges of the fins 40 decreases water turbulence as is flows off of the fins 40 further increasing the smoothness of the ride for the user.

Should the base member and wings have pointed edged instead of rounded or beveled edges, the fins may also have pointed edges (not illustrated).

Extending from the top half of each fin 40 to the bottom half of each fin 40 is a cutaway portion 44. These cutaway portions 44 provide user hand grips 46. The edges of the cutaway portions 44 may be rounded to afford a more comfortable grip by the user. Optionally, the hand grips 46 may be padded for additional user comfort.

The fins 40 are attachable to and detachable from the base member 10. The base member 10 has two partial cut away portions 32. Each of these cutaway portions 32 receives one of the fins 40. Additionally, each fin 40 has a partial cutaway portion 48. This cutaway portion 48 receives the base member 10.

In order to attach a fin 40 to the base member 10, the fin 40 is slid onto the base member 10 so that the fin's cutaway portion 48 receives the base member 10, and the base member's cutaway portion 32 receives the fin 40.

A locking latch means 50 permits the hand grip 46 of the fin 40 to pass over the base member 10. The latch means 50 is opened when the fin 40 is passing over the base member 10, and the latch means 50 is closed and locked when the fin 40 is in place.

Optional guides (not illustrated) can be provided to help the fin 40 slide into place onto the base member 10. The guides 34 also help maintain the fin 40 in a stationary position on the base member 10. Two guides are located on the top surface 12 of the base member 10, and two guides are located on the bottom surface 14 of the base member 10, for each fin 40.

In order to detach the fin 40 from the base member 10, the latch means 50 is opened to permit the fin 40 is slide off of the base member 10.

When both of the fins 40 are detached from the base member 10, the fins 40 and base member 10 can be stacked on top of each other. This provides a relatively compact stack for storage and transportation. Reassembly is quick and easy.

In order to utilize the invention, a tow line 60 is attached to the attachment ring 30. The device is pulled through the water by the tow line 60.

Alternatively, the user can affix the tow line to a stationary object, such as a tree, and use a water body's current for propulsion.

In order to maneuver through the water, the user grasps either the base member hand grip or the fins' hand grips. If the fins' hand grips are used, horizontal control is provided by tension release. The device will go to the side where arm tension on the device is greater. If a user wants to go left, then he reduces tension in his right arm. A right-hand turn is achieved by reducing tension in the left arm. In either case, substantial arm strength is not required in order to maneuver the device.

If the user desires vertical control, hand grip positioning is changed. If the user desires to dive with the device, then he drops his hands to the lower part of the hand grips. This will result in increased water flow turbulence on the underside of the device. The less turbulent water flow, and thus relatively higher flow pressure, on the top side of the device will attempt to equalize the pressure differential by pushing downward on the device, thereby achieving a dive.

If the user desires to surface with the device, he grasps the upper part of the hand grips. This will result in increased water flow turbulence on the top side of the device. The less turbulent water flow, and thus relatively higher flow pressure, on the underside of the device will attempt to equalize tile pressure differential by pushing upward on the device, thereby surfacing the device. Substantial arm strength is not required to achieve a diving or surfacing maneuver.

If level progress is desired, the user grasps the fins' hand grips at their mid-point with equal tension on both arms and proceeds.

Alternatively, the user can grasp the device by the base member hand grip. Left-hand turn and right-hand turn control is achieved in the same manner as described above for grasping the device by the fins' hand grips. That is, if a left-hand turn is desired, the user reduces tension in his right arm. A right-hand turn is achieved by reducing tension in the left arm of the user.

A second method to turn the device when utilizing the base member hand grip is to shift the user's hands to the left end of the hand grip. The resulting water flow turbulence created on the left-hand side of the device will result in a left hand turn. If a right-hand turn is desired, the hands are shifted to the right end of the hand grip. In either case, substantial arm strength is not required.

If the user desires to dive, he pulls up on the hand grip using either his arm or wrist muscles. This will result in increased water flow turbulence on the underside of the device. The less turbulent water flow, and thus relatively higher flow pressure, on the top side of the device will attempt to equalize the pressure differential by pushing downward on the device, thereby achieving a dive.

If the user desires to surface with the device, he pushes down on the device. This will result in increased water flow turbulence on the top side of the device. The less turbulent water flow, and thus relatively higher flow pressure, on the underside of the device will attempt to equalize the pressure differential by pushing upward on the device, thereby surfacing the device. In either case, diving or surfacing, substantial arm or wrist strength is not necessary.

If level progress is desired, the user grasps the device in the center of the base member hand grip and proceeds. If the base member hand grip is utilized, the device can be controlled with one hand.

The invention can be constructed of any durable light weight material, such as plastic, or fiberglass covered wood. The buoyancy of the device should be higher than that of water. By being buoyant, the device will surface, if the user looses his grip or otherwise lets go of the invention. If the device is non-buoyant, it will tend to sink to the bottom if the user lets go of the invention.

Alternatively, the device can be made of very lightweight material such as Styrofoam. When so constructed, the device can be utilized as an air maneuvering device by skydivers. The device would be identical in construction and function as the underwater model.

While the invention has been particularly shown and described with reference to embodiments thereof, it will be understood by those skilled in the art that various changes in form and detail may be made without departing from the spirit and scope of the invention.

I claim:

1. An aquatic maneuvering comprising:

a) a base member having a center portion, a first end portion to the left of the center portion, a second end portion to the right of the center portion, and a pair of apertures on the back of the center portion defining a hand grip;

b) a first fin, with an aperture defining a hand grip located on the first fin's back portion, attached to the base member at a point to the left of the midpoint of the base member, and extending above and below the base member;

c) a second fin, with an aperture defining a hand grip located on the second fin's back portion, attached to the base member at a point to the right of the midpoint of the base member, and extending above and below the base member; and wherein the top side of the device is symmetrical to the bottom side of the device.

2. The device as in claims 1 to further include an attachment ring located on the front of the center portion.

3. The device as in claim 1 wherein all outer edges of the base member and all outer edges of the first fin and the second fin are rounded.

4. An aquatic maneuvering comprising:

a) a base member having a center portion, a first end portion to the left of the center portion and swept backward, a second end portion to the right of the center portion and swept backward, a pair of apertures on the back of the center portion defining a hand grip and an attachment ring on the front of the center portion;

b) a swept back first fin, with an aperture defining a hand grip located on its back portion, removably attached to the base member at a point to the left of the midpoint of the base member, and extending above and below the base member;

c) a swept back second fin, with an aperture defining a hand grid located on its back portion, removably attached to the base member at a point to the right of the midpoint of the base member, and extending above and below the base member;

wherein the left side of the device is symmetrical to the right side of the device and the top side of the device is symmetrical to the bottom side of the device; and wherein all outer edges of the base member and all outer edges of the first fin and the second fin are rounded.

* * * * *